US008251877B2

(12) United States Patent
Rasmussen et al.

(10) Patent No.: US 8,251,877 B2
(45) Date of Patent: Aug. 28, 2012

(54) SYSTEMS AND METHODS FOR FUNCTIONAL TRAINING EXERCISES HAVING FUNCTION-SPECIFIC USER INTERFACES

(75) Inventors: Robert A. Rasmussen, Bellevue, WA (US); A. Buell Ish, III, Redmond, WA (US)

(73) Assignee: Vectra Fitness, Inc., Redmond, WA (US)

( * ) Notice: Subject to any disclaimer, the term of this patent is extended or adjusted under 35 U.S.C. 154(b) by 0 days.

(21) Appl. No.: 11/771,738

(22) Filed: Jun. 29, 2007

(65) Prior Publication Data

US 2008/0051263 A1 Feb. 28, 2008

Related U.S. Application Data

(63) Continuation-in-part of application No. 11/467,079, filed on Aug. 24, 2006, now Pat. No. 7,998,036.

(51) Int. Cl.
*A63B 21/06* (2006.01)
*A63B 21/062* (2006.01)

(52) U.S. Cl. ..... 482/100; 482/93; 482/139

(58) Field of Classification Search ..... 482/133, 482/138, 92–103, 139, 908
See application file for complete search history.

(56) References Cited

U.S. PATENT DOCUMENTS 2,942,698 A 6/1960 Bolinger
3,102,298 A 9/1963 Sheahan
3,462,156 A * 8/1969 Gentry ..... 473/229
4,229,002 A * 10/1980 Masters ..... 482/94
4,603,855 A * 8/1986 Sebelle ..... 482/103
4,821,369 A 4/1989 Daniels
4,898,381 A * 2/1990 Gordon ..... 482/103
5,211,614 A * 5/1993 Henes ..... 482/102
5,242,344 A * 9/1993 Hundley ..... 482/93
5,267,930 A * 12/1993 Henes ..... 482/139
5,421,636 A 6/1995 Gamble
5,423,730 A * 6/1995 Hirsch ..... 482/92
5,799,366 A 9/1998 Zocco et al.
5,916,072 A 6/1999 Webber (Continued)

OTHER PUBLICATIONS

Cybex, "The Cybex Ft 360 Functional Trainer", retrieved on Sep. 8, 2005 at http://www.ecybex.com/products/Strength/FT360Index.aspx, 2 pages.

Freemotion Fitness, "FreeMotion Dual Cable Cross", retrieved on Sep. 8, 2005 at http://www.iconfitness.com/cgi-bin/ncommerce3/ExecMacro/product/freeMotion/v3/produc...., two pages.

(Continued)

*Primary Examiner* — Loan Thanh
*Assistant Examiner* — Daniel F Roland

(57) ABSTRACT

Systems and methods for functional training exercises having a function-specific user interface are disclosed. In one embodiment, an exercise assembly for performing a functional training exercise that simulates an activity involving a hand-held device includes a load, a support assembly, and a force-transferring assembly. A user interface includes a handle configured to resemble at least a portion of the hand-held device that is grasped by a user. An interface coupling assembly pivotably couples the handle and the force-transferring assembly. A training force applied to the handle by the user during movement of the handle along a functional training path induces an associated force on the load. In particular embodiments, the handle is configured to resemble a golf club, a baseball bat, a racquet, a hockey stick, and a sporting device configured to be thrown, such as a baseball.

14 Claims, 11 Drawing Sheets

U.S. PATENT DOCUMENTS

| | | | | |
|---|---|---|---|---|
| 5,924,966 | A * | 7/1999 | Havlovic | 482/129 |
| 5,951,444 | A * | 9/1999 | Webber | 482/99 |
| 6,090,020 | A | 7/2000 | Webber | |
| 6,443,877 | B1 * | 9/2002 | Hoecht et al. | 482/103 |
| 6,447,430 | B1 * | 9/2002 | Webb et al. | 482/98 |
| 6,488,612 | B2 * | 12/2002 | Sechrest et al. | 482/103 |
| 6,770,015 | B2 * | 8/2004 | Simonson | 482/99 |
| 6,905,446 | B2 | 6/2005 | Greenland | |
| 6,949,035 | B1 * | 9/2005 | Halsworth | 473/453 |
| 7,094,185 | B2 | 8/2006 | Greenland | |
| 7,096,533 | B2 | 8/2006 | Griepentrog | |
| 7,101,327 | B1 | 9/2006 | Baumler et al. | |
| 7,169,093 | B2 * | 1/2007 | Simonson et al. | 482/103 |
| 7,179,209 | B2 * | 2/2007 | Sechrest et al. | 482/103 |
| 2002/0013200 | A1 | 1/2002 | Sechrest et al. | |
| 2003/0017918 | A1 * | 1/2003 | Webb et al. | 482/94 |
| 2003/0027697 | A1 | 2/2003 | Baumler | |
| 2003/0100413 | A1 * | 5/2003 | Huang | 482/100 |
| 2003/0176261 | A1 * | 9/2003 | Simonson et al. | 482/103 |
| 2004/0214697 | A1 | 10/2004 | Gerschefske et al. | |
| 2006/0247097 | A1 | 11/2006 | La Voie et al. | |

OTHER PUBLICATIONS

Image, retrieved on Sep. 8, 2005 at http://www.tuffstuff.net/retail/images/home_equip/home_gyms/acs100/ACSMain.jpg, 1 page.

Life Fitness, "New Life Fitness G5 Gym System", retrieved on Sep. 8, 2005 at http://us.home.lifefitness.com/content.cfm/g5, pp. 1-4, plus additional page.

Paramount, "Functional Training System Model FT-150", retrieved on Sep. 8, 2005 at http://www.paramountfitness.com/pages/ft/150.html, 1 page.

Paramount, "Paramount Functional Trainer Model PFT-200", retrieved on Sep. 8, 2005 at http://www.paramountfitness.com/pages/ft/200.html, 1 page.

SNEWS, "HFBiz Show '05: Strength Equipment Has, Yes, Strong Showing", Posted Sep. 6, 2005 in Category(s): Fitness, from http://www.snewsnet.com, pp. 1-7.

Vortex, "Functional & Core Strength Training Systems Featuring the Vortex "Grab & Train"", retrieved on Sep. 8, 2005 at http://www.vortexfitness.com/exercise_equipment_products/Pro_Trainer.html, pp. 1-4.

* cited by examiner

SYSTEMS AND METHODS FOR FUNCTIONAL TRAINING EXERCISES HAVING FUNCTION-SPECIFIC USER INTERFACES

CROSS-REFERENCE TO RELATED APPLICATIONS

This patent application is a continuation in part of co-pending, commonly-owned U.S. patent application Ser. No. 11/467,079 entitled "Functional Training Exercise Apparatus and Methods" filed on Aug. 24, 2006, which application is incorporated herein by reference.

FIELD OF THE INVENTION

This invention relates generally to systems and methods for functional training exercises having a function-specific user interface to enable a user to perform functional training movements, that is, movements that more closely approximate the movements associated with a chosen activity, including sports, hobbies, work, therapeutic activities, and other movements performed in daily life.

BACKGROUND OF THE INVENTION

The advantages of weight-training exercise machines are widely recognized. Conventional weight-training exercise machines may feature single or multiple stations which enable a user to perform one or a variety of exercises for developing and toning different muscle groups. For example, the various stations of such exercise machines may include one or more stations that enable a user to exercise muscles of the arms and upper body using "press," "shrug," or "curl" types of movements, and one or more stations for exercising muscles of the legs using "squat," "press," or "extension" types of movements. Such weight machines provide the desired muscle training capability in a convenient, safe, and efficient manner.

Although prior art exercise apparatus and methods have achieved desirable results, there is room for improvement. For example, some users may desire to enhance their ability to perform certain movements, such as those movements associated with a particular sport, work, hobby, therapeutic movement, or other desired activity. For example, sometimes a user may wish to strengthen muscles associated with a particular sporting activity, such as swinging a sporting apparatus (e.g. a bat, racquet, stick, golf club, etc.). Similarly, the user may wish to strengthen muscles used in throwing a sporting device (e.g. baseball, shot put, discus, football, etc.), or gardening (e.g. shoveling), or any other desired activity. Although prior art apparatus enable a user to exercise a variety of different muscle groups using a variety of different movements, the standard movements afforded by such apparatus (e.g. press, shrug, curl, squat, extension, etc.) may not closely resemble the actual movements associated with the user's chosen activity. Therefore, exercise systems and methods that more closely approximate the movements associated with the user's chosen activity would have utility.

SUMMARY OF THE INVENTION

Embodiments of the invention are directed to systems and methods for functional training exercises having a function-specific user interface to enable a user to perform functional training movements, that is, movements that more closely approximate the movements associated with a chosen activity, including sports, hobbies, work, therapeutic activities, and other movements performed in daily life. Embodiments of the invention may advantageously provide improved capability to enable a user to develop muscles associated with the user's chosen activity, including, for example, swinging or throwing a sporting device, or any other desired functional training activity.

In one embodiment, an exercise assembly for performing a functional training exercise that simulates an activity involving a hand-held device includes a load, a support assembly operatively positioned relative to the load, and a force-transferring assembly operatively coupled to the load and to the support assembly. A user interface is operatively coupled to the force-transferring assembly and includes a handle configured to resemble at least a portion of the hand-held device that is configured to be grasped by a user, and an interface coupling assembly pivotably coupled to the handle and further coupled to the force-transferring assembly. The interface coupling assembly and the force-transferring assembly are configured such that a training force applied to the handle by the user during movement of the handle along a functional training path induces an associated force on the load.

In various alternate embodiments, the handle may be configured to resemble a golf club, a baseball bat, a racquet, a hockey stick, and a sporting device configured to be thrown, such as a baseball. Similarly, in various alternate embodiments, the functional training path includes at least one of a portion of a golf swing, a baseball bat swing, a racquet swing, a hockey stick swing, and a throwing motion.

In another embodiment, a method of performing a functional training exercise that simulates an activity involving a hand-held device includes: providing a support assembly operatively positioned relative to a load; providing a force-transferring assembly operatively coupled to the load and to the support assembly; coupling a functional training user interface to the force-transferring assembly, the user interface including a handle configured to resemble at least a portion of the hand-held device that is configured to be grasped by a user, and an interface coupling assembly pivotably coupled to the handle and further coupled to the force-transferring assembly; and applying a training force to the handle to move the handle along a functional training path that simulates the activity involving the hand-held device, the interface coupling assembly and the force-transferring assembly being configured such that the training force applied to the handle induces an associated force on the load.

BRIEF DESCRIPTION OF THE DRAWINGS

Embodiments of the invention are described in detail below with reference to the following drawings.

DETAILED DESCRIPTION

Many specific details of certain embodiments of the invention are set forth in the following description and in FIGS. 1-20 to provide a thorough understanding of such embodiments. One skilled in the art, however, will understand that the present invention may have additional embodiments, or that the present invention may be practiced without several of the details described in the following description.

Functional Training Exercise Apparatus and Methods

In general, embodiments of apparatus and methods in accordance with the present invention enable a user to perform exercises using functional training movements. As used in this disclosure, the term functional training movements refers to movements for training the body the way it will be used in activities of daily living, including movements associated with sports, or movements associated with a user's work, hobby, or therapeutic activities. Examples of functional training movements include, but are not limited to, torso bending and twisting movements, pushing and pulling movements, and sporting movements such as swinging a sporting apparatus (e.g. a bat, racquet, stick, golf club, etc.), throwing or tossing a sporting device (e.g. a baseball, shot put, discus, football, etc.), or any other desired functional training movements.

Figure 1:
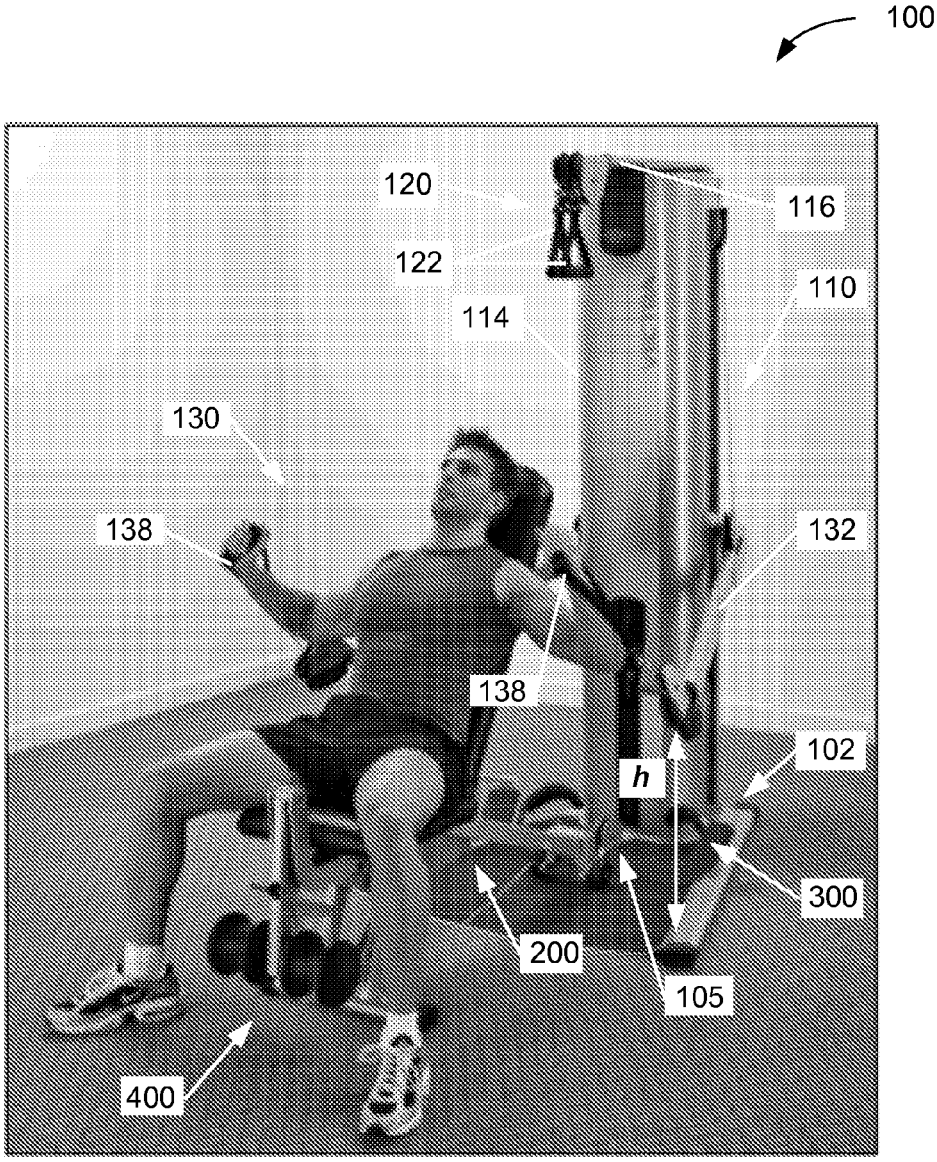
FIG. 1 is an isometric view of a functional training exercise assembly in accordance with an embodiment of the invention.
Figure 2:
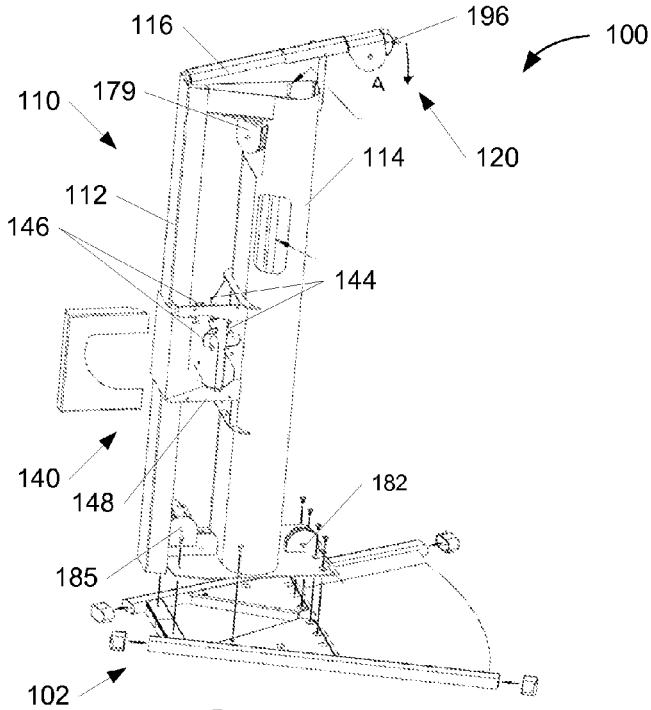
FIG. 2 is a partially-exploded isometric view of the functional training exercise assembly of FIG. 1.

FIG. 1 is an isometric view of a functional training exercise assembly 100 in accordance with an embodiment of the invention. FIG. 2 is a partially-exploded side view of the functional training exercise assembly 100 of FIG. 1. In this embodiment, the functional training exercise assembly 100 includes an upwardly extending central portion 110 coupled to a base assembly 102 that rests on a support surface (e.g. a floor). The central portion 110 includes an upright support member 112 and a shield member 114 proximate to the upright support member 112. A lateral support member 116 extends from the upright support member 112 to a first exercise station 120. As shown in FIG. 1, the first exercise station 120 may include a pair of first handles 122.

Figure 10:
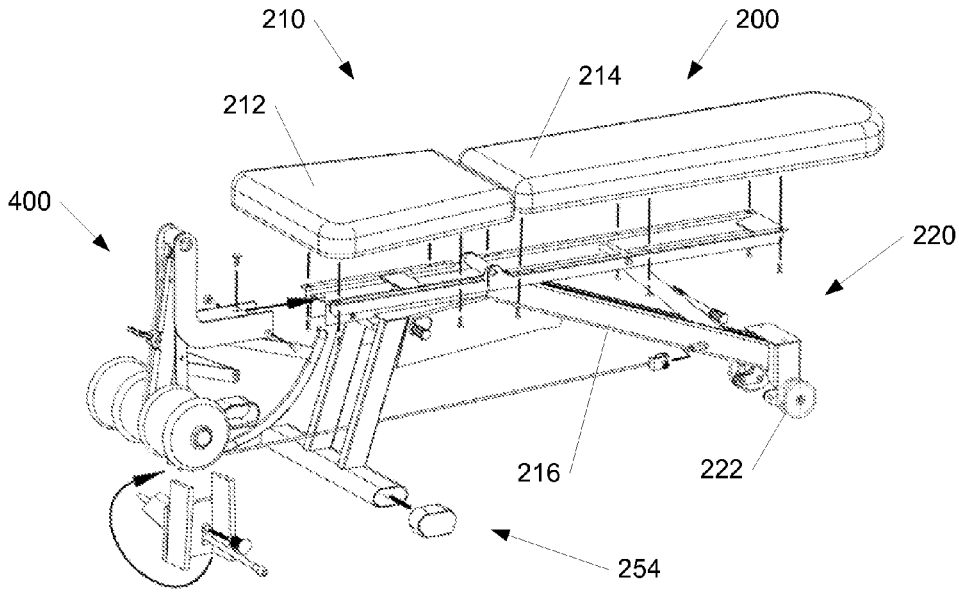
FIG. 10 is a partially-exploded isometric view of a bench assembly of the functional training exercise assembly of FIG. 1.

A second exercise station 130 is coupled to the upright support member 112 and the shield member 114 by an adjustable coupling assembly 140 (shown in FIG. 2). A bench assembly 200 (FIG. 1) may be positioned proximate the shield member 114 to support a user during use of the first and second exercise stations 120, 130. One suitable embodiment of the bench assembly 200 is shown in FIG. 10.

Figure 3:
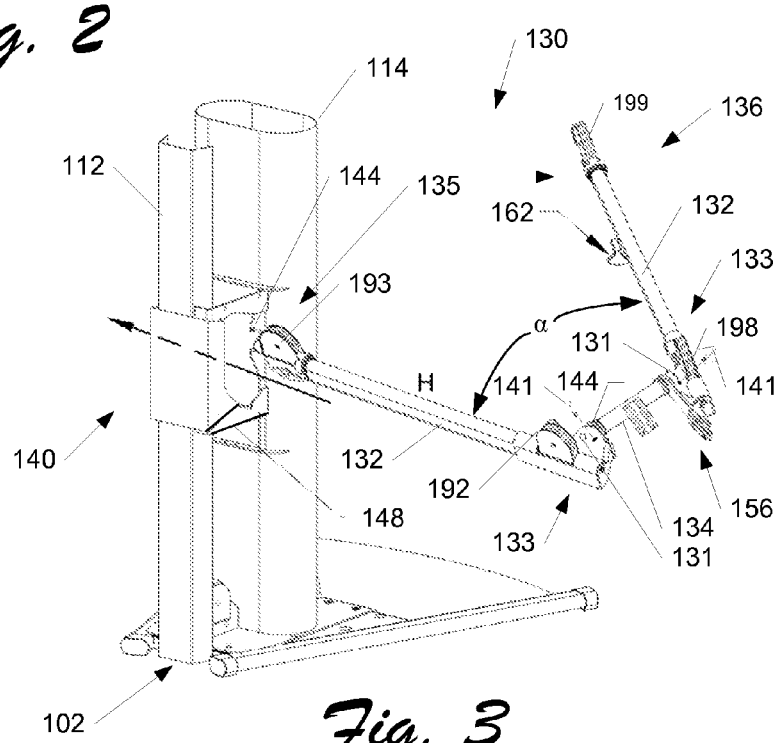
FIG. 3 is a partially disassembled isometric view of the functional training exercise assembly of FIG. 1.

As best shown in FIG. 3, the second exercise station 130 includes a pair of frame members 132, each frame member 132 having a proximal end portion 133 coupled to a cross member 134. A pair of second handles 138 (FIG. 1) are located at distal end portions 135 of the frame members 132. In FIG. 3, the cross member 134 is shown in a partially-disassembled position 136 relative to the adjustable coupling assembly 140. The cross member 134 engages with the adjustable coupling assembly 140 to enable the frame members 132 of the second exercise station 130 to be adjustably positioned by a user to a desired height h (FIG. 1) relative to the base assembly 102, as described more fully below.

In some embodiments, the frame members 132 are separate components that are coupled together by the cross member 134, and in other embodiments, the frame members 132 and the cross member 134 are different portions of a single, unitary member. In further embodiments, the assembly including the frame members 132 and the cross member 134 may be formed from two pieces (e.g. two "L"-shaped members), or any other suitable number of pieces. In general, each frame member 132 projects outwardly from the cross member at an angle having a corresponding vertex such that the assembly including the frame members 132 and the cross member 132 generally forms an angled member having a pair of angles and a pair of vertices.

More specifically, in some embodiments, the frame members 132 are rigidly coupled to the cross member 134 at a fixed angle $\alpha$. Alternately, the proximal end portions 133 may be pivotably (or hingeably) coupled to the cross member 134 by pivotable coupling assemblies 131 to enable the angle $\alpha$ to be adjusted as desired by the user. After adjustment to a desired value, the angle $\alpha$ may remain fixed during the exercise, such as by providing the user with a locking pin 141 selectively engageable through one or more suitable portions of the pivotable coupling assembly 131 (and the frame and cross members 132, 134) to lock the frame member 132 in a fixed position relative to the cross member 134. Alternately, the locking pin 141 may be disengaged to enable the angle $\alpha$ to vary freely during an exercise.

Furthermore, for some functional training exercises, it may be desirable for the user to allow the angle $\alpha$ to vary freely during the exercise to enable the user to perform the desired functional training movements using one or both of the second handles 138 of the second exercise station 130. In some embodiments, as shown in FIG. 3, the pivotable coupling assemblies 131 may allow the frame members 132 to move independently of one another to vary the angle α by moving only one of the frame members 132. In alternate embodiments, however, the pivotable coupling assemblies 131 may constrain the frame members 132 to move together (dependently). Thus, the functional training exercise assembly 100 allows the user to perform functional training movements that more closely approximate movements associated with daily life, including, for example, a particular sporting event or a particular movement associated with a user's hobby, work, or therapeutic activities.

Figure 4:
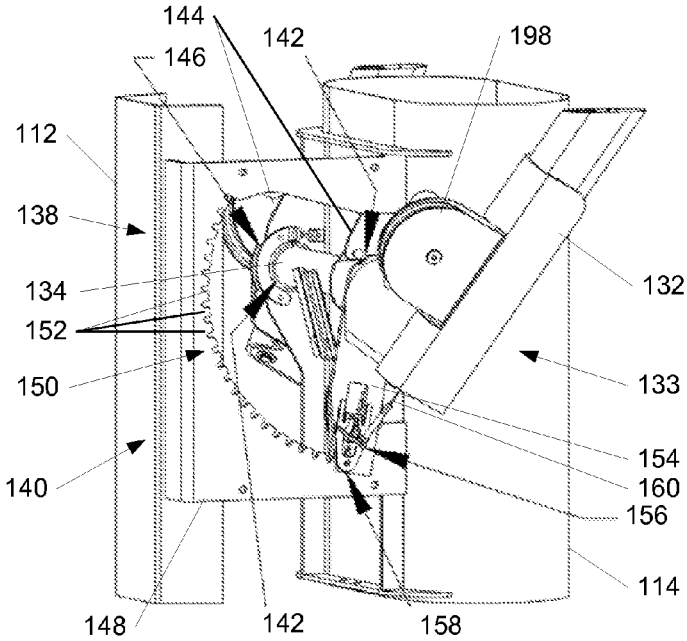
FIGS. 4 and 5 are enlarged, isometric views of an adjustable coupling assembly in an assembled position with a cross member of FIG. 3.
Figure 5:
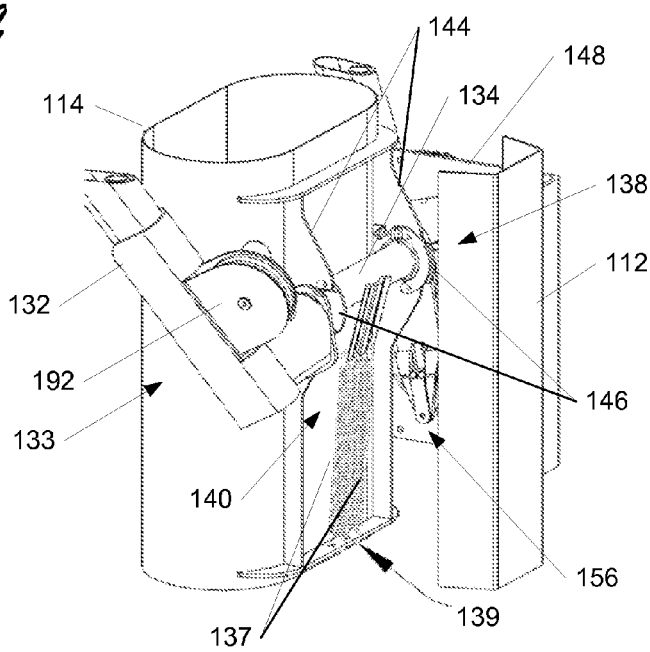

FIGS. 4 and 5 are enlarged, isometric views of the adjustable coupling assembly 140 with the cross member 134 in an assembled position 138. In this embodiment, a pair of bushings 142 are positioned on the cross member 134 and are fittingly engaged into a corresponding pair of brackets 144 on the shield member 114. Bushing retainers 146 are secured to the brackets 144 to retain the bushings 144 into position within the brackets 144. A pair of biasing devices (or springs) 137 are coupled between the cross member 134 and a cross bracket 139 (FIG. 5) on the shield member 1 14.

As best shown in FIG. 4, a plate 148 extends between the upright support member 112 and the shield member 114. The plate 148 includes an indexing portion 150 having a plurality of indexing members 152 (e.g. teeth or slots). A locking arm 154 is coupled to the cross member 134 and extends toward the indexing portion 150 of the plate 148. A locking assembly 156 is coupled to the locking arm 154 and includes a retractable portion 158 that selectively engages with one or more of the indexing members 152. A coupling member (e.g cable) 160 couples the retractable portion 158 to a release lever 164 positioned on one of the frame members 132 (FIG. 3). The structure and operation of the release lever 164 and locking assembly 156 may be of any suitable type, including those devices described, for example, in U.S. Pat. No. 6,508,748 issued to Ish.

In operation, a user may adjust the positions of the frame members 132 of the second exercise station 130 to any desired height h relative to the base assembly 102. More specifically, the user may actuate the release lever 162 to cause the retractable portion 158 of the locking assembly 156 to disengage from the indexing portion 150 of the plate 148, enabling the frame members 132 to be raised and lowered to the desired height h. The user may then perform functional training exercises using the second exercise station 130, as described more fully below.

Figure 6:
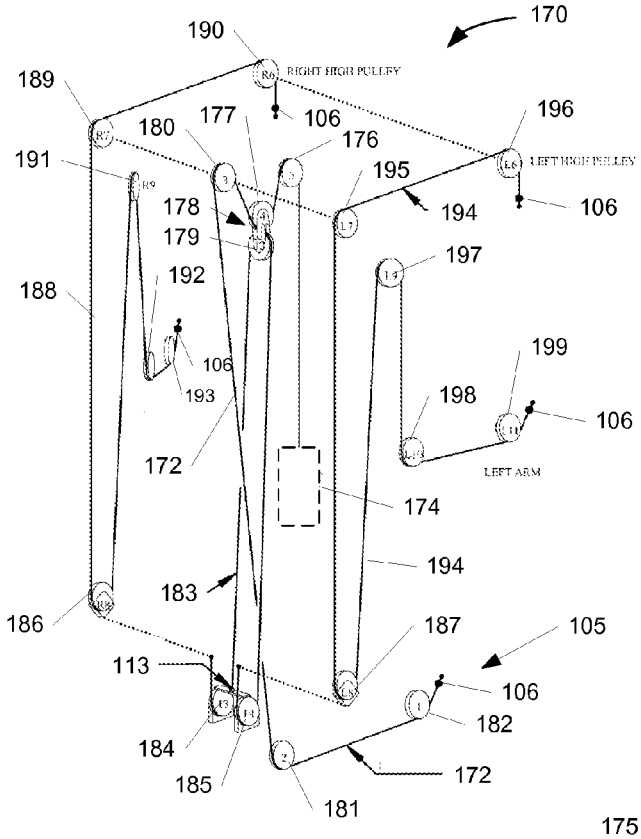
FIG. 6 is a cable and pulley assembly of the functional training exercise assembly of FIG. 1.
Figure 7:
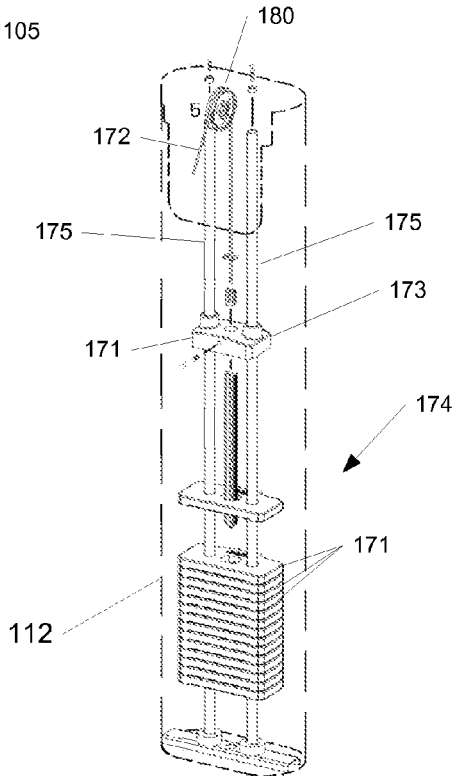
FIG. 7 is an enlarged, partially hidden view of a central portion of the functional training exercise assembly of FIG. 1.

FIG. 6 is a cable and pulley assembly 170 of the functional training exercise assembly 100 of FIG. 1. In this embodiment, the cable and pulley assembly 170 includes a first cable 172 having a first end that is coupled to a load 174 disposed within a lower portion of the shield member 1 14. As best shown in FIG. 7, in this case, the load 174 consists of one or more plates 171 of a weight stack. The plates 171 are selectively coupled to an engagement member 173 attached to the first cable 172 (shown in a partially disassembled view in FIG. 7), and are slideable along a pair of guide members 175 in a conventional manner.

As further shown in FIG. 6, the first cable 172 operatively engages a first fixed pulley 176 positioned above the weight stack 174. The first cable 172 then engages an upper pulley 177 of a first double-floating pulley 178, a second fixed pulley 180 positioned above the first double-floating pulley 178, third and fourth fixed pulleys 181, 182 positioned below the second fixed pulley 180 (e.g. proximate the base assembly 102), and terminates at a third exercise station 105 such as, for example, a low-pull station.

Figure 9:
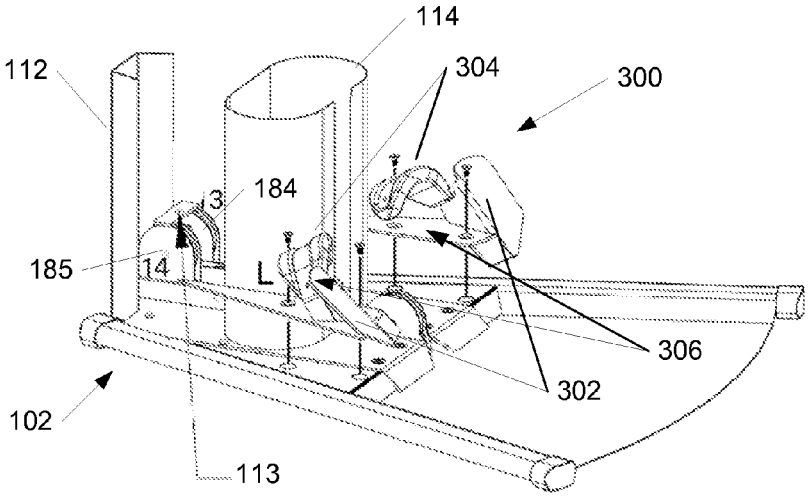
FIG. 9 is an enlarged, partially hidden view of a lower portion of the functional training exercise assembly of FIG. 1.

A second cable 183 engages a lower pulley 179 of the first double-floating pulley 178 and extends downwardly to engage with fifth and sixth fixed pulleys 184, 185. One possible structural arrangement of the cable and pulley assembly 170 and the lower portion of the exercise assembly 100 is shown in FIG. 9. In the embodiment shown in FIGS. 6 and 9, the fifth and sixth fixed pulleys 184, 185 are positioned proximate the base assembly 102 and near the upright support member 112. A tension adjustment member 113 engages the fifth and sixth fixed pulleys 184, 185 and enables the fifth and sixth fixed pulleys 184, 185 to be adjusted vertically in order to controllably adjust the tension and in the second cable 183. The ends of the second cable 183 are coupled to first and second single floating pulleys 186, 187 (FIG. 6).

Figure 8:
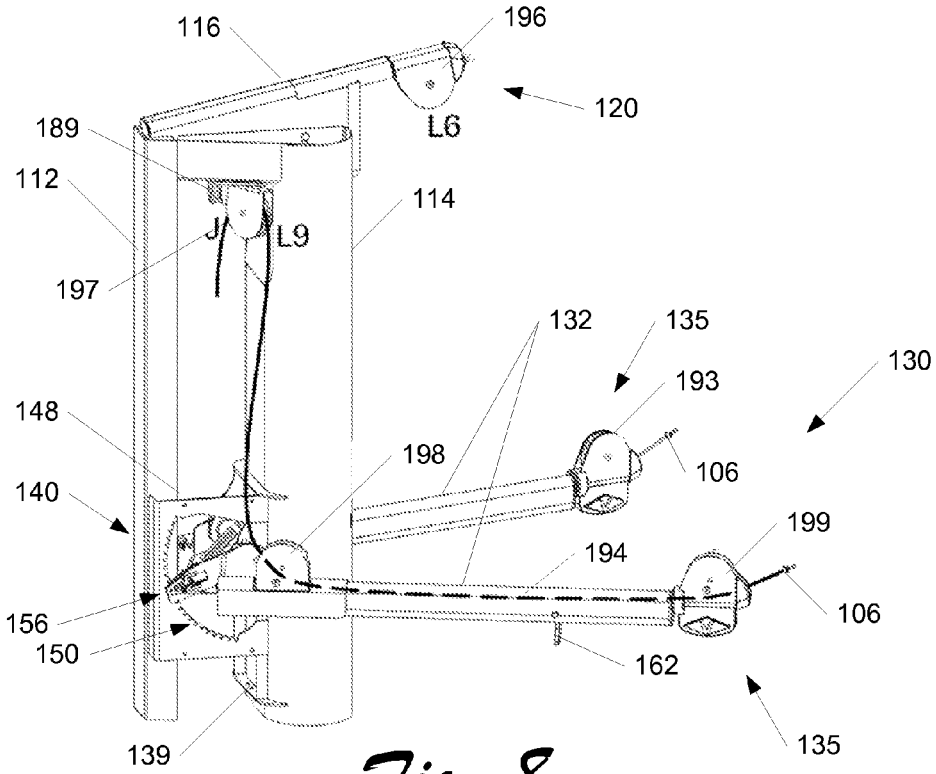
FIG. 8 is an enlarged, partially hidden view of an upper portion of the functional training exercise assembly of FIG. 1.

With continued reference to FIG. 6, the cable and pulley assembly 170 further includes a third cable 188 that operatively engages the first single floating pulley 186. From the first single floating pulley 186, the third cable 188 extends upwardly to a seventh fixed pulley 189 positioned proximate an upper portion of the upright support member 112, and to an eighth fixed pulley 190 coupled to the lateral support member 116. A first end of the third cable 188 terminates at the first exercise station 120, and may be coupled to one of the first handles 122 (FIG. 1). The third cable 188 also extends from the first single floating pulley 186 upwardly to a ninth fixed pulley 191, and then to tenth and eleventh fixed pulleys 192, 193 coupled to proximal and distal portions 133, 135, respectively, of one of the frame members 132 (see FIG. 2). One possible embodiment of a structural relationship between the cable and pulley assembly 170 and the frame members 132 of the second exercise station 130 is shown in FIG. 8.

Similarly, a fourth cable 194 engages the second single floating pulley 187 and extends upwardly to a twelfth fixed pulley 195 positioned proximate an upper portion of the upright support member 112, and to a thirteenth fixed pulley 196 coupled to the lateral support member 116. A first end of the fourth cable 188 terminates at the first exercise station 120, and may be coupled to one of the first handles 122 (FIG. 1). As further shown in FIG. 6, the fourth cable 194 also extends from the second single floating pulley 187 to a fourteenth fixed pulley 197, and then engages with fifteenth and sixteenth fixed pulleys 198, 199 coupled to proximal and distal portions 133, 135, respectively, of the other of the frame members 132 (see FIG. 2). The second handles 138 of the second exercise station 130 (FIG. 1) are coupled to the ends of the third and fourth cables 188, 194.

As best shown in FIG. 6, a plurality stops 106 are coupled to the cables 172, 188, 194 proximate the exercise stations 120, 130, 105. The stops 106 are known devices that enable tension forces to be developed within one or more of the cables 172, 183, 188, 194 when a user applies a training force at one of the exercise stations 120, 130, 105. The structural and operational aspects of the stops 106 are generally known, as described, for example, in U.S. Pat. No. 6,582,346 issued to Line et al., U.S. Pat. No. 6,482,135 issued to Ish et al., and U.S. Pat. No. RE 34,572 issued to Johnson et al., which patents are incorporated herein by reference.

FIG. 9 is an enlarged view of a lower portion of the functional training exercise assembly 100 showing a partially-exploded foot-retaining assembly 300 in accordance with an embodiment of the invention. The foot-retaining assembly 300 includes a pair of retaining braces 302 that are coupled to the base assembly 102 that rests on a support surface (e.g. a floor). In this embodiment, the retaining braces 302 project upwardly and outwardly from the base assembly 102. A foot pad 304 is coupled to each retaining brace 302. The foot pad 304 and the retaining brace 302 are configured to cooperatively provide a foot-retaining space 306 adapted to receive a portion of a user's foot.

FIG. 10 is a partially exploded isometric view of a bench assembly 200 in accordance with another embodiment of the invention. In this embodiment, the bench assembly 200 includes a support portion 210, a wheel assembly 220 having a pair of wheels 222, and an exercise station 400. More specifically, the support portion 210 includes first and second pad members 212, 214 coupled to a frame assembly 216. In some embodiments, the position of the second pad member 214 is pivotably adjustable, as described, for example, in U.S. patent application Ser. No. 10/913,136 by Ish et al., which application is incorporated herein by reference. The frame assembly 216 rests on a support surface and supports the support portion 210 during use by the user.

In operation, a user may select one of the exercise stations 120, 130, 105 and a suitable number of plates 171 to serve as a training load 174. For example, using the first exercise station 120, the user may apply a training force on one or both of the first handles 122 (e.g. by pulling downwardly on the handles 122), causing tension in the cable and pulley assembly 170 and applying a lifting force on the training load 174. Similarly, using the third exercise station 105, the user may apply a training force on the end of the second cable 172 (e.g. by pulling upwardly on a handle or bar, not shown), causing tension in the cable and pulley assembly 170 and applying a lifting force on the training load 174.

When using the second exercise station 130, the user may adjust the height h of the frame members 132 relative to the base assembly 102 as described above. The user may then apply a training force on one or both of the second handles 138, causing tension in the cable and pulley assembly 170 and applying a lifting force on the training load 174. For those embodiments having pivotable coupling assemblies 131 that allow adjustment of the angle a between the frame members 132, the user may adjust the angle a to a desired value for performing an exercise. The angle a may remain fixed during the exercise, or alternately, may vary freely during the exercise, allowing the user considerable freedom to perform functional training movements during the exercise using the second exercise station 130.

Embodiments of apparatus and methods having adjustable frame members in accordance with the present invention may advantageously provide improved capability to enable a user to develop muscles associated with the user's every day life, such as a chosen sporting event, a hobby, or work or therapeutic activities, thereby enabling the user to perform exercises using functional training movements. More specifically, because the frame members are variably adjustable in both height h and angle $\alpha$, the user may more readily perform movements intended to develop muscles associated with the user's chosen sporting event, including, for example, swinging a sporting apparatus, throwing or tossing a sporting device, or any other desired functional training movements associated with any desired activity.

Function-Specific User Interfaces for Functional Training Exercises

Functional training exercises may be enhanced by providing exercise systems having function-specific user interfaces. In this way, the functional-training movements associated with the user's chosen activity may more accurately simulate the actual movements performed by the user during the actual activities of daily living, including movements associated with sports, or movements associated with a user's work, hobby, or therapeutic activities. The following sections describe certain embodiments of function-specific user interfaces that may be employed using functional training apparatus, including those functional training systems and methods disclosed above.

Figure 11:
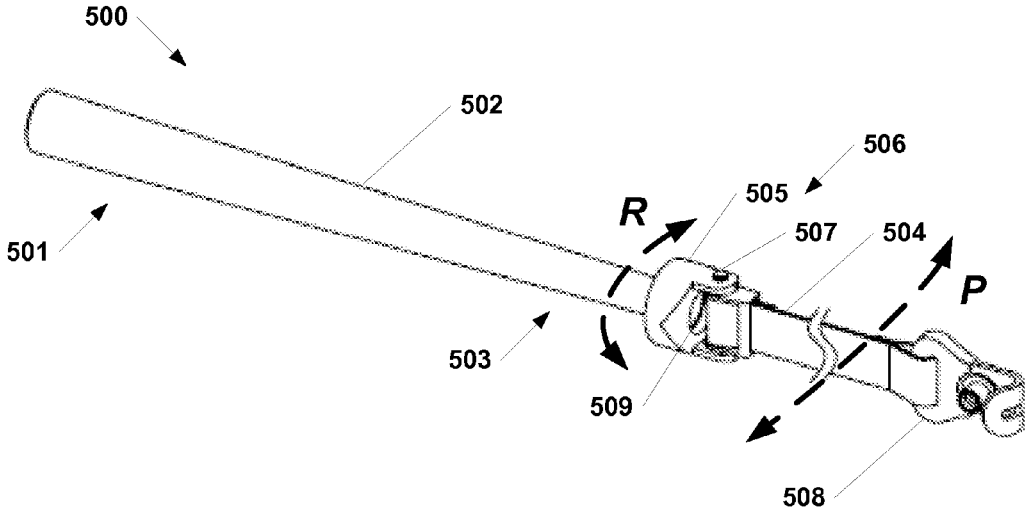
FIG. 11 is an enlarged isometric view of a golf club user interface assembly in accordance with an alternate embodiment of the invention.

FIG. 11 is an enlarged isometric view of a golf club user interface assembly 500 in accordance with an embodiment of the invention. In this embodiment, the user interface assembly 500 includes a handle 502 that is configured to resemble a handle of a golf club. More specifically, the handle 502 tapers from a larger end portion 501 to a smaller end portion 503. A flexible coupling member 504 (e.g. a strap) is attached to the smaller end portion 503 of the handle 502 by a coupling assembly 506.

In this embodiment, the coupling assembly 506 includes a U bracket 505 that is secured to the handle 502 by a securing member 509, and a pin 507 that extends across the U bracket 505. The flexible coupling member 504 is attached to the pin 507 such that the coupling member 504 is pivotably attached to the handle 502, allowing the flexible coupling member 504 to swing freely back and forth along a pivot path P. In some embodiments, the securing member 509 allows the U bracket 505 to rotate, thereby allowing the flexible coupling member 504 to rotate freely back and forth along a rotation path R with respect to the handle 502. A coupling member 508 (e.g. a hook) is attached to the flexible coupling member 504 opposite from the handle 502.

Figure 12:
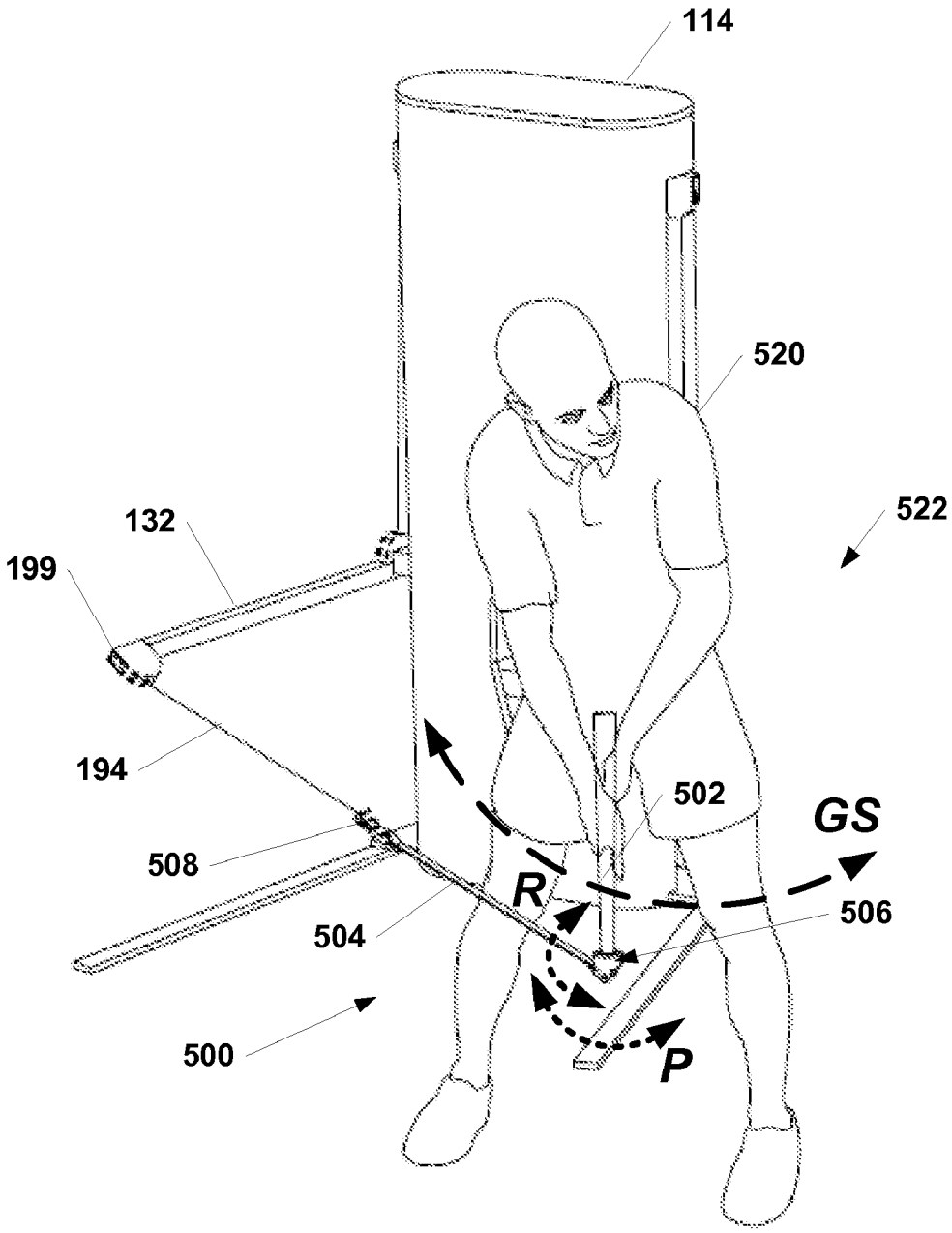
FIG. 12 is an isometric view of a user performing a golf-training exercise using the golf club user interface assembly of FIG. 11 in accordance with a particular embodiment of the invention.

FIG. 12 is an isometric view of a user 520 performing a golf-training exercise 522 using the golf club user interface assembly 500 of FIG. 11 in accordance with an embodiment of the invention. In this embodiment, the user 520 attaches the coupling member 508 to the fourth cable 194 in place of the second handle 138 of the second exercise station 130 (FIG. 1). The user 520 may then adjust the height of the frame member 132 to a suitable height for performing the golf-training exercise 522 via the adjustable coupling assembly 140 as described above with respect to FIG. 8. The user 520 selects an appropriate number of plates 171 to use as a training load 174 for the golf-training exercise 522.

After the setup activities described above, the user 520 prepares to perform the golf-training exercise 522 by grasping the handle 502 of the golf club user interface assembly 500 and assuming an appropriate golf stance (e.g. for driving, chipping, putting, etc.). The user 520 then moves (or swings) the handle 502 along an arc GS that is characteristic of a golf swing the user 520 wishes to practice. As the handle 502 is moved along the arc GS, the handle 502 may pivot P and rotate R to allow the user 520 to move the handle 502 in a functional training movement that simulates or approximates a golf swing. Also, as the user 520 moves the handle 502, the fourth cable 194 of the cable and pulley assembly 170 exerts a training force on the training load 174, providing a desired resistance for the user 520 during the golf-training exercise 522. In this way, as the user performs the golf-training exercise 522 the appropriate muscles of the user's body (e.g. arms, legs, torso, etc.) used during golfing may be functionally trained and strengthened.

Figure 13:
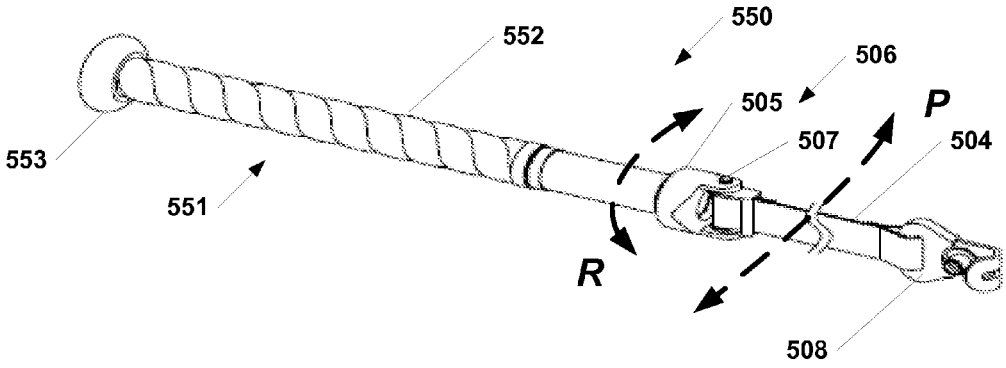
FIG. 13 is an enlarged isometric view of a baseball bat user interface assembly in accordance with an alternate embodiment of the invention.

Similarly, FIG. 13 is an enlarged isometric view of a baseball bat user interface assembly 550 in accordance with an alternate embodiment of the invention. In this embodiment, the user interface assembly 550 includes a handle 552 that is configured to resemble a handle of a baseball bat. More specifically, the handle 522 has an approximately cylindrical or tapered portion 551 and an enlarged knob portion 553. The flexible coupling member 504 (e.g. a strap) is attached to the handle 552 by the coupling assembly 506 as described above.

Figure 14:
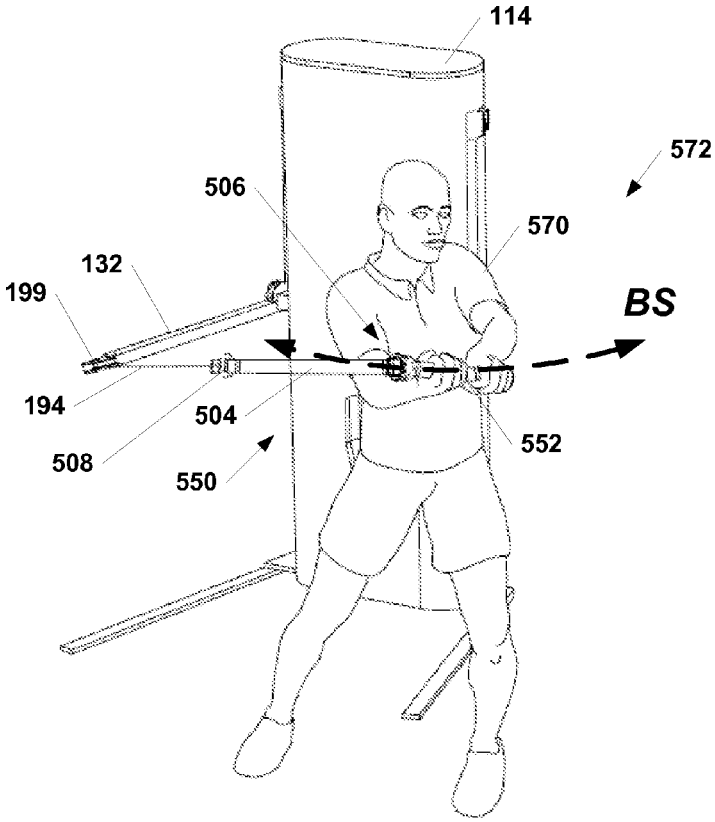
FIG. 14 is an isometric view of a user performing a batting-training exercise using the baseball bat user interface assembly of FIG. 13 in accordance with another particular embodiment of the invention.

FIG. 14 is an isometric view of a user 570 performing a batting-training exercise 572 using the baseball bat user interface assembly 550 of FIG. 13 in accordance with another embodiment of the invention. To set up for this functional training exercise, the user 520 couples the baseball bat user interface assembly 550 to the fourth cable 194, adjusts the height of the frame member 132 to a suitable height for performing the batting-training exercise 552, and selects an appropriate number of plates 171 to use as a training load 174.

The user 570 grasps the handle 552 of the baseball bat user interface assembly 550 and assumes an appropriate batting stance. The user 520 then moves (or swings) the handle 552 along an arc BS that is characteristic of a batting swing. As the handle 552 is moved along the arc BS, the handle 552 may pivot P and rotate R (FIG. 13) to allow the user 570 to move the handle 552 in a functional training movement that simulates or approximates a batting swing. Also, as the user 570 moves the handle 552, the fourth cable 194 of the cable and pulley assembly 170 exerts a training force on the training load 174, providing a desired resistance for the user 570 during the batting-training exercise 572. In this way, as the user 570 performs the batting-training exercise 572 the appropriate muscles of the user's body (e.g. arms, legs, torso, etc.) used during batting may be functionally trained and strengthened.

Figure 15:
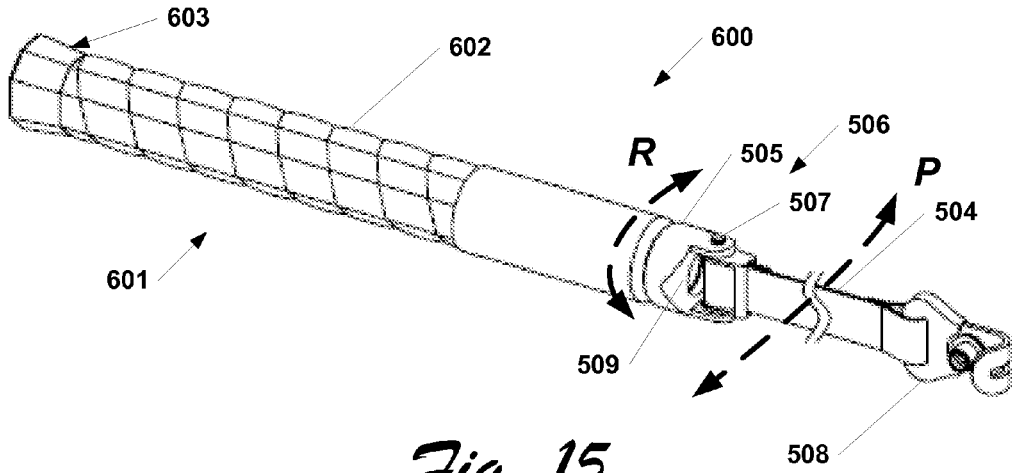
FIG. 15 is an enlarged isometric view of a racquet user interface assembly in accordance with an alternate embodiment of the invention.

Similarly, FIG. 15 is an enlarged isometric view of a racquet style user interface assembly 600 in accordance with an alternate embodiment of the invention. In this embodiment, the user interface assembly 600 includes a handle 602 that is configured to resemble a handle of a racquet, such as may be used for tennis, racquetball, or the like. The handle 602 has a faceted portion 601 and a flared end portion 603. In the manner of a conventional tennis or racquetball racquet, the cross sectional shape of the faceted portion 601 may be an octagon, a hexagon, or any other suitable polygonal shape. The flexible coupling member 504 (e.g. a strap) is attached to the handle 602 by the coupling assembly 506 as described above.

Figure 16:
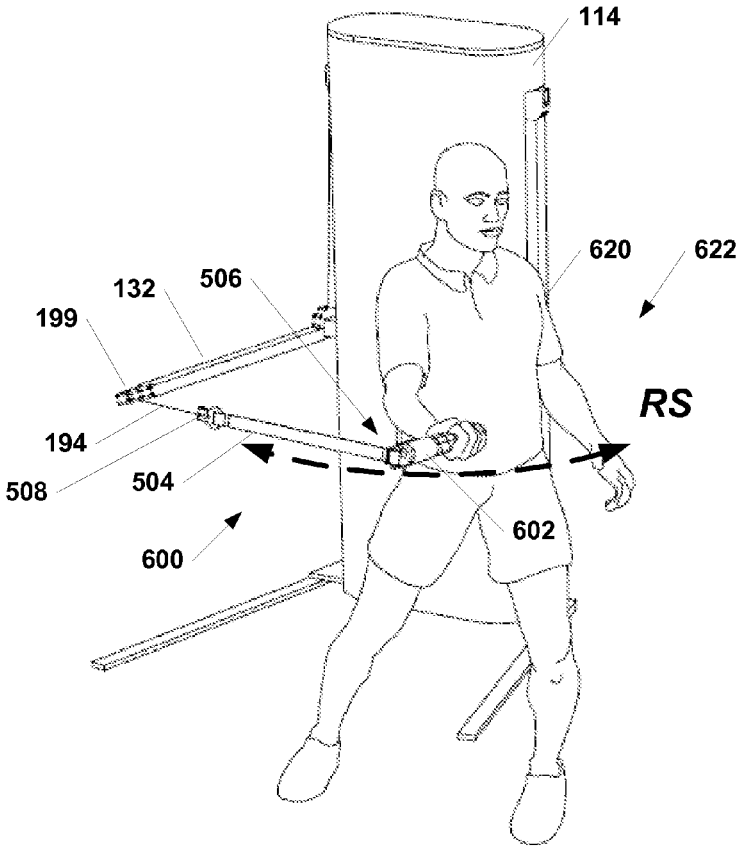
FIG. 16 is an isometric view of a user performing a racquet-training exercise using the racquet user interface assembly of FIG. 15 in accordance with another embodiment of the invention.

FIG. 16 is an isometric view of a user 620 performing a racquet-training exercise 622 using the racquet user interface assembly 600 of FIG. 15 in accordance with another embodiment of the invention. As described above, the user 620 may set up for the racquet-training exercise 622 by coupling the racquet user interface assembly 600 to the fourth cable 194, adjusting the height of the frame member 132 to a suitable height, and selecting an appropriate number of plates 171 to use as a training load 174 for performing the racquet-training exercise 622.

As further shown in FIG. 16, the user 620 grasps the handle 602 of the racquet user interface assembly 600 and assumes an appropriate stance. The user 620 then moves (or swings) the handle 602 along an arc RS that is characteristic of a racquet swing of an activity the user wishes to simulate, such as tennis, racquetball, badminton, or other racquet-involving activity. As the handle 602 is moved along the arc RS, the handle 602 may pivot P and rotate R (FIG. 15) to allow the user 620 to move the handle 602 in a functional training movement that simulates or approximates a racquet swing. Also, as the user 620 moves the handle 602, the fourth cable 194 of the cable and pulley assembly 170 exerts a training force on the training load 174, providing a desired resistance for the user 620 during the racquet-training exercise 622. In this way, as the user 620 performs the racquet-training exercise 622 the appropriate muscles of the user's body (e.g. arms, legs, torso, etc.) used during swinging a racquet may be functionally trained and strengthened.

Figure 17:
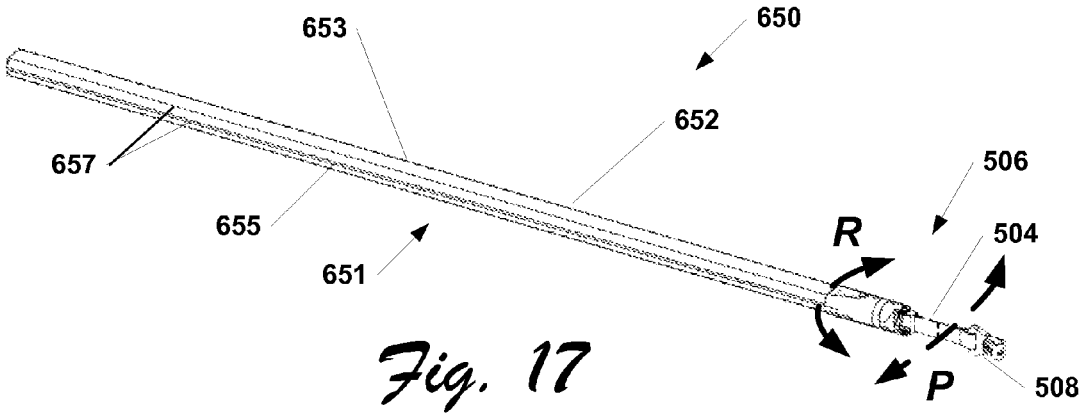
FIG. 17 is an enlarged isometric view of a stick style user interface assembly in accordance with yet another embodiment of the invention.

FIG. 17 is an enlarged isometric view of a stick-style user interface assembly 650 in accordance with yet another embodiment of the invention. In this embodiment, the user interface assembly 650 includes a handle 652 that is configured to resemble an elongated handle as found on a hockey stick, lacrosse stick, field hockey stick, or the like. The handle 652 has an elongated faceted portion 651. As shown in FIG. 17, the faceted portion 652 may be non-uniformly or asymmetrically faceted. More specifically, in this embodiment, the handle 652 has a pair of major surfaces 653 (only one visible), a pair of minor surfaces 655 (only one visible), and four intermediate surfaces 657 (only two visible). Of course, in alternate embodiments, other configurations of faceted portions 652 may be used, such as symmetrically faceted handles having an octagonal, a hexagonal, or any other suitable polygonal cross-sectional shape. As in the previously described embodiments, the flexible coupling member 504 (e.g. a strap) is pivotably and rotatably attached to the handle 652 by the coupling assembly 506 as described above.

Figure 18:
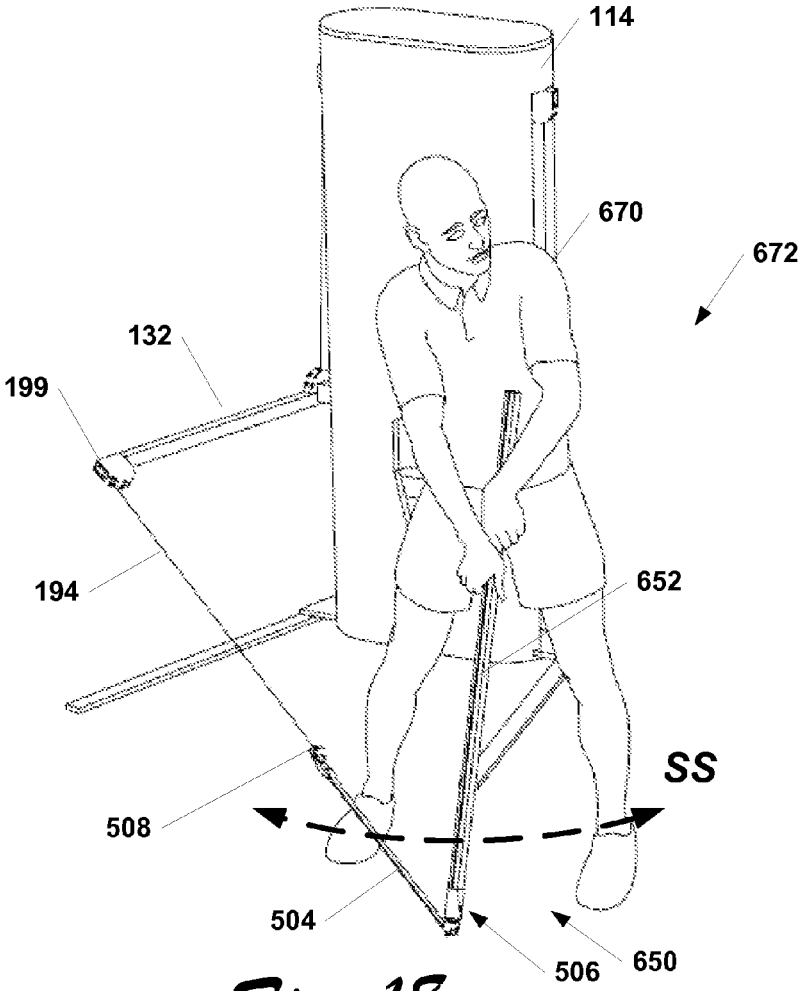
FIG. 18 is an isometric view of a user performing a stick-handling exercise using the stick user interface assembly of FIG. 17 in accordance with still another embodiment of the invention.

FIG. 18 is an isometric view of a user 670 performing a stick-handling exercise 672 using the stick-style user interface assembly 650 in accordance with still another embodiment of the invention. Again, the user 670 may set up for the stick-handling exercise 6722 by coupling the stick-style user interface assembly 650 to the fourth cable 194, adjusting the height of the frame member 132 to a suitable height, and selecting an appropriate number of plates 171 to use as a training load 174 for performing the stick-handling exercise 672.

The user 670 then grasps the handle 652 of the stick-style user interface assembly 650 and assumes an appropriate stance. The user 670 then moves (or swings) the handle 652 along an arc SS that is characteristic of a stick swing or other stick-handling activity the user 670 wishes to simulate, including for example those stick-handling activities that occur in hocky, lacrosse, field hockey, or any other suitable stick-handling activity. As the handle 652 is moved along the arc SS, the handle 652 may pivot P and rotate R (FIG. 17) to allow the user 670 to move the handle 652 in a functional training movement that simulates or approximates a stick swing. Also, as the user 670 moves the handle 652, the fourth cable 194 of the cable and pulley assembly 170 exerts a training force on the training load 174, providing a desired resistance for the user 670 during the stick-handling exercise 672, allowing the appropriate muscles of the user's body (e.g. arms, legs, torso, etc.) used during swinging or maneuvering a stick to be functionally trained and strengthened.

Figure 19:
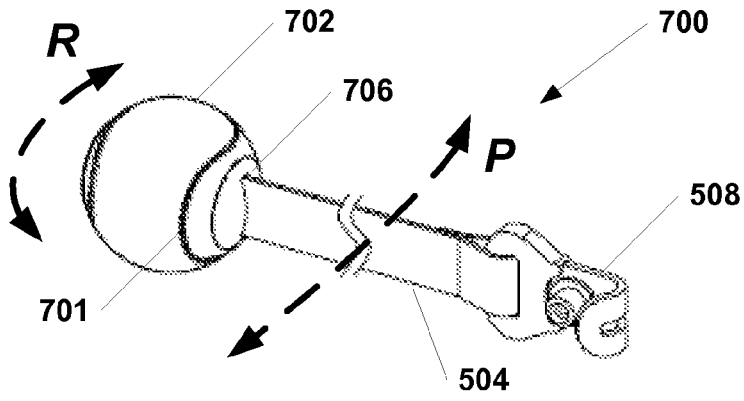
FIG. 19 is an enlarged isometric view of a ball user interface assembly in accordance with an alternate embodiment of the invention.

The previously-described embodiments of function-specific user interface assemblies have included a handle that is configured to simulate a sporting apparatus that is held by the user throughout the sporting activity. In alternate embodiments, however, the user interface assembly may include a handle that is configured to simulate a sporting apparatus that is thrown. For example, FIG. 19 is an enlarged isometric view of a ball user interface assembly 700 in accordance with another alternate embodiment of the invention. In this embodiment, the user interface assembly 700 includes a handle 702 that is configured to resemble a ball, and more specifically, a baseball. The handle 702 is approximately spherical and has raised portions 701 that are configured to simulate stitching or laces on a baseball. A flexible coupling member 504 (e.g. a strap) is pivotably and rotatably attached to the handle 702 by a coupling assembly 706.

Figure 20:
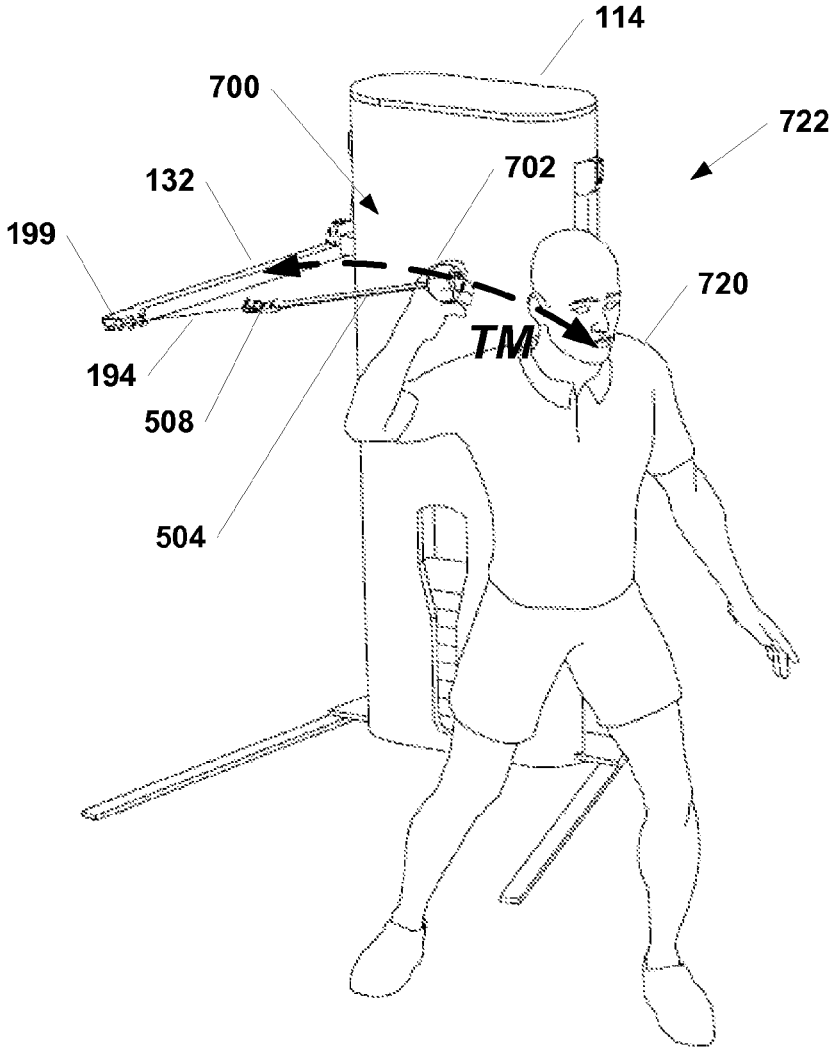
FIG. 20 is an isometric view of a user performing a throwing-training exercise using the ball user interface assembly of FIG. 19 in accordance with yet another embodiment of the invention.

FIG. 20 is an isometric view of a user 720 performing a throwing-training exercise 722 using the ball user interface assembly 700 of FIG. 19 in accordance with yet another embodiment of the invention. To set up for this functional training exercise, the user 720 couples the ball user interface assembly 700 to the fourth cable 194, adjusts the height of the frame member 132 to a suitable height for performing the throwing-training exercise 722, and selects an appropriate number of plates 171 to use as a training load 174.

The user 720 then grasps the handle 702 of the ball user interface assembly 700 and assumes an appropriate throwing stance. The user 720 then moves the handle 702 along an arc TM that is characteristic of a throwing motion. As the handle 702 is moved along the arc TM, the handle 702 may pivot P and rotate R (FIG. 19) to allow the user 720 to move the handle 702 in a functional training movement that simulates or approximates a throwing motion (e.g. an overhand throwing or pitching motion). Also, as the user 720 moves the handle 702, the fourth cable 194 of the cable and pulley assembly 170 exerts a training force on the training load 174, providing a desired resistance for the user 720 during the throwing-training exercise 722. In this way, as the user 720 performs the throwing-training exercise 722 the appropriate muscles of the user's body (e.g. arms, legs, torso, etc.) used during throwing may be functionally trained and strengthened.

It will be appreciated that a variety of alternate embodiments in accordance with the teachings of the present disclosure may be conceived, and that the invention is not limited to the particular embodiments described above and shown in the accompanying figures. For example, although the handle 702 shown in FIGS. 19 and 20 is configured to resemble a baseball, in alternate embodiments, the handle 702 may be configured to resemble any other type of sporting apparatus that is thrown, including a football, javelin, dart, or any other throwable device. Furthermore, although the embodiment shown in FIG. 20 depicts a throwing-training exercise 722 that simulates an approximately overhand throwing motion, in alternate embodiments, the handle 702 may be moved in any other desired training motion, such as underhand throwing, or the motions involved in putting a shot, hurling a discus or hammer, rolling a bowling ball, or any other desired throwing activity.

Embodiments of exercise methods and systems having function-specific user interface assemblies in accordance with the teachings of the present disclosure may advantageously provide improved capability to enable a user to develop muscles associated with the user's chosen activity, including, for example, swinging or throwing a sporting device, or any other desired functional training activity. By providing a handle having a suitable configuration, and by coupling the handle to a force transferring assembly of an exercise machine in a pivotable and rotatable manner, embodiments of the invention provide improved functional training capabilities in comparision with the prior art.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An exercise assembly for performing a functional training exercise that simulates an activity involving a hand-held device, comprising:

a load;

a support assembly operatively positioned relative to the load, the support assembly including an upwardly projecting portion and a first outwardly extending frame member having a proximal end portion adjustably coupled to the upwardly projecting portion by a coupling assembly, and further having a first distal end portion spaced apart from the proximal end portion;

a first force-transferring assembly operatively coupled to the load and to the first distal end portion of the support assembly; and a first user interface operatively coupled to the first force-transferring assembly, the user interface including:

a handle configured to resemble at least a portion of the hand-held device that is configured to be grasped by a user; and an interface coupling assembly that operatively couples the handle to the first force-transferring assembly, the interface coupling assembly including:

a coupling member attached to the first force-transferring assembly;

a flexible member coupled to the coupling member; and a handle attachment assembly comprising an approximately U-shaped portion rotatably coupled to the handle, and a pin member that spans the approximately U-shaped portion and pivotably couples the flexible member to the approximately U-shaped portion; and wherein the interface coupling assembly and the first force-transferring assembly are configured such that a training force applied to the handle by the user during movement of the handle along a functional training path induces an associated force on the load, and wherein the handle freely rotates with respect to the approximately U-shaped portion during movement of the handle along the functional training path.

2. The exercise assembly of claim 1, wherein the handle freely rotates with respect to the approximately U-shaped portion without winding up the flexible member during movement of the handle along the functional training path.

3. The exercise assembly of claim 1, wherein the handle is configured to resemble at least a portion of at least one of a golf club, a baseball bat, a racquet, and a hockey stick.

4. The exercise assembly of claim 1, wherein the coupling assembly is further configured to enable controllable adjustment of a height of the distal end to be higher than the proximal end of the first outwardly extending frame member in a first adjustment, to be lower than the proximal end of the first outwardly extending frame member in a second adjustment, and to be the same height as relative to a support surface as the proximal end of the first outwardly extending frame member in a third adjustment.

5. The exercise assembly of claim 1, wherein the handle is configured to resemble at least a portion of at least one of a sporting device configured to be thrown, a ball, and a baseball.

6. The exercise assembly of claim 1, further comprising:

a second outwardly extending frame member coupled to the upwardly projecting portion by the coupling assembly, the second frame member having a proximal end portion pivotably and adjustably coupled about the non-vertical axis to the coupling assembly, and a second distal end portion spaced apart from the proximal end portion;

a second force-transferring assembly operatively coupled to the load and to the second distal end portion of the support assembly; and a second user interface operatively coupled to the force-transferring assembly, the user interface including:

a handle configured to resemble at least a portion of the hand-held device that is configured to be grasped by the user; and an interface coupling assembly pivotably coupled to the handle and further coupled to the second force-transferring assembly, wherein the interface coupling assembly and the second force-transferring assembly are configured such that a training force applied to the handle by the user during movement of the handle along a functional training path induces an associated force on the load.

7. The exercise assembly of claim 6, wherein the coupling assembly includes:

a base member coupled to the upwardly projecting portion, the base member including an indexing portion; and a locking assembly operatively engaged with the base member and including a locking member selectively engageable with the indexing portion to secure the first and second outwardly projecting frame members at the selected height.

8. The exercise assembly of claim 6, wherein the coupling assembly is configured to enable controllable adjustment of a height of the distal ends of the first and second outwardly extending frame members relative to a support surface.

9. The exercise assembly of claim 8, wherein the coupling assembly is further configured to enable controllable adjustment of an angle between the outwardly extending frame members.

10. The exercise assembly of claim 1, wherein the handle attachment assembly permits both pivotal and rotational motion of the handle with respect to the the flexible member during movement of the handle along the functional training path without twisting the flexible member.

11. The exercise assembly of claim 1, wherein the first force-transferring assembly includes:

a first cable coupled to the load;

a second cable operatively engaged with the first cable by a double floating pulley;

first and second single floating pulleys coupled to corresponding first and second ends of the second cable; and third and fourth cables operatively engaged with the first and second single floating pulleys, respectively; and wherein the interface coupling assembly is coupled to at least one of the third and fourth cables.

12. An exercise assembly for performing a functional training exercise that simulates an activity involving a hand-held device, comprising:

a load;

a support assembly operatively positioned relative to the load, the support assembly including an upwardly projecting portion and a pair of outwardly projecting portions adjustably coupled by a coupling assembly to the upwardly projecting portion and each outwardly projecting portion having a proximal end portion adjustably coupled to the upwardly projecting portion, and having a distal end spaced apart from the upwardly projecting portion;

a force-transferring assembly operatively coupled to the load and to the support assembly and including a first portion coupled to and extending at least partially along each outwardly projecting portion to the distal end of each outwardly projecting portion;

a user interface operatively coupled to the force-transferring assembly, the user interface including:

a handle configured to resemble at least a portion of the hand-held device that is configured to be grasped by a user; and an interface coupling assembly that operatively couples the handle to the force-transferring assembly, the interface coupling assembly including:

a coupling member attached to the force-transferring assembly;

a flexible member coupled to the coupling member; and a handle attachment assembly comprising an approximately U-shaped portion rotatably coupled to the handle, and a pin member that spans the approximately U-shaped portion and pivotably couples the flexible member to the approximately U-shaped portion; and wherein the interface coupling assembly and the force-transferring assembly are configured such that a training force applied to the handle by the user during movement of the handle along a functional training path induces an associated force on the load, and wherein the handle freely rotates with respect to the approximately U-shaped portion during movement of the handle along the functional training path.

13. The exercise assembly of claim 12, wherein the coupling assembly is further configured to enable controllable adjustment of a height of the distal end relative to a support surface.

14. The exercise assembly of claim 12, wherein the handle freely rotates with respect to the approximately U-shaped portion without winding up the flexible member during movement of the handle along the functional training path.

* * * * *